US009289357B2

(12) United States Patent
Itzek

(10) Patent No.: US 9,289,357 B2
(45) Date of Patent: Mar. 22, 2016

(54) BOTTLE TEAT

(75) Inventor: Eckhard Itzek, Gyhum-Nartum (DE)

(73) Assignee: MAPA GmbH GUMMI- UND PLASTIKWERKE

( * ) Notice: Subject to any disclaimer, the term of this patent is extended or adjusted under 35 U.S.C. 154(b) by 450 days.

(21) Appl. No.: 12/673,296

(22) PCT Filed: Jul. 31, 2008

(86) PCT No.: PCT/EP2008/006297

§ 371 (c)(1),
(2), (4) Date: Dec. 7, 2010

(87) PCT Pub. No.: WO2009/024252

PCT Pub. Date: Feb. 26, 2009

(65) Prior Publication Data

US 2011/0062105 A1 Mar. 17, 2011

(30) Foreign Application Priority Data

Aug. 21, 2007 (DE) ..... 10 2007 039 355

(51) Int. Cl.

| | |
|---|---|
| ***A61J 11/00*** | (2006.01) |
| ***A61J 11/02*** | (2006.01) |
| ***B65D 47/20*** | (2006.01) |
| ***A47G 21/18*** | (2006.01) |
| ***A61J 11/04*** | (2006.01) |

(52) U.S. Cl.

CPC ..... *A61J 11/001* (2013.01); *A47G 21/185* (2013.01); *A61J 11/0015* (2013.01); *A61J 11/02* (2013.01); *A61J 11/04* (2013.01); *A61J 11/045* (2013.01); *B65D 47/2031* (2013.01)

(58) Field of Classification Search

CPC ... A61J 11/02; A61J 11/0015; A61J 11/0035; A61J 11/005; A61J 11/001; A61J 11/0085; B65D 47/2031; A47G 21/185

USPC ..... 215/11.1–11.6; 220/714, 717, 229, 253, 220/367.1, 203.19; 137/846, 849; 251/212, 251/349

See application file for complete search history.

(56) References Cited

U.S. PATENT DOCUMENTS

| | | | | |
|---|---|---|---|---|
| 3,674,183 | A | 7/1972 | Venable | |
| 5,601,207 | A * | 2/1997 | Paczonay | 220/703 |
| 5,673,806 | A * | 10/1997 | Busnel | 215/11.1 |
| 5,784,999 | A * | 7/1998 | Larson et al. | 119/71 |
| 5,797,505 | A * | 8/1998 | Kaura | 215/11.5 |
| 6,161,710 | A * | 12/2000 | Dieringer et al. | 215/11.4 |
| 6,645,228 | B2 * | 11/2003 | Renz | 606/236 |
| 6,994,225 | B2 * | 2/2006 | Hakim | 215/11.4 |

(Continued)

FOREIGN PATENT DOCUMENTS

| | | |
|---|---|---|
| CH | 357194 | 11/1961 |
| DE | 32 22 280 A1 | 1/1983 |
| DE | 20 2005 014 621 U1 | 1/2007 |

(Continued)

*Primary Examiner* — Fenn Mathew
*Assistant Examiner* — Jennifer Castriotta
(74) *Attorney, Agent, or Firm* — Vidas, Arrett & Steinkraus

(57) ABSTRACT

A bottle teat made of a soft elastic material, comprising: a hollow suction nipple, a circumferential mounting edge for fixation to the bottle opening of a drinking bottle, a hollow transition zone between the mounting edge and the suction nipple, and two drinking slots extending from the outer side to the inner side of the suction nipple in an end region of the suction nipple, which are aligned in parallel to each other and whose distance from each other decreases from the outer side towards the inner side of the suction nipple.

28 Claims, 1 Drawing Sheet

(56) References Cited

U.S. PATENT DOCUMENTS

2002/0158075 A1* 10/2002 Caldicott et al. ..... 220/714
2006/0175278 A1* 8/2006 Schlumpf ..... 215/11.1

FOREIGN PATENT DOCUMENTS

EP 1 681 044 A1 1/2005
GB 2066795 7/1981

* cited by examiner

BOTTLE TEAT

CROSS-REFERENCE TO RELATED APPLICATIONS

Not applicable.

STATEMENT REGARDING FEDERALLY SPONSORED RESEARCH

Not applicable.

BACKGROUND OF THE INVENTION

The present invention is related to a bottle teat made from a soft elastic material.

Bottle teats serve for the nutrition of sucklings and infants. Known bottle teats have a hollow suction nipple and a circumferential mounting edge for fixation to a bottle opening on a drinking bottle. Since the mounting edge has a cross-section larger than that of the suction nipple, there is a hollow transition zone between the suction nipple and the mounting edge which expands from the suction nipple to the mounting edge. At its end region, the suction nipple has a drinking hole through which liquid can exit. A ventilation valve with a valve slot is often located within the transition zone. The bottle teat is fixed to the aperture edge of the drinking bottle by means of a threaded ring. To this end, the bottle teat is slid through the threaded ring until the mounting edge comes to sit below an annular flange of the threaded ring. The threaded ring is screwed onto an external thread of the drinking bottle, by which action the mounting edge is clamped between the opening edge of the bottle opening and the threaded ring. Likewise, it is known to realize the ventilation valve by suitable channels in the seat region of the mounting edge on the opening edge of the drinking bottle.

The infant can withdraw the liquid or other fluid food that is filled into the drinking bottle by sucking at the suction nipple. In this, food exits through the drinking hole and pressure compensation with the surroundings takes place via a ventilation valve.

The known bottle teats have the disadvantage that they only permit a small flow of the food that is to be provided. If the drinking hole is constructed too large, the liquid can flow out without obstruction and with no suction work performed by the infant. As a result, the infant is not trained in taking up food and the food might be spilled. Further, the take-up of food is restricted by the ventilation valve which limits the pressure balance.

From CH 357 149, a bottle teat is already known, with a drinking slot directed in the longitudinal direction of the suction nipple and extending from the outer side up to the inner side of the suction nipple in an outer end region of the suction nipple.

Starting from this, the present invention is based on the objective to provide a bottle teat made of a soft elastic material which permits an increased flow of the food that is to be provided, without adversely affecting the natural sucking process, and which still seals reliably and prevents any unintentional spill of food in an efficient way.

BRIEF SUMMARY OF THE INVENTION

The bottle teat according to the present invention made from a soft elastic material has a hollow suction nipple, a circumferential mounting edge for fixation to the bottle opening of a drinking bottle, a hollow transition zone between the mounting edge and the suction nipple, and two drinking slots extending from the outside to the inside of the suction nipple in an end region of the suction nipple, which are aligned in parallel to each other and whose distance from each other decreases from the outer side towards the inner side of the suction nipple.

In the teat according to the present invention, an increased flow of the drink or the food that is to be provided is achieved by the two parallel drinking slots whose distance decreases from the outer side towards the inner side of the suction nipple. That is to say, when sucking takes place, the region of the suction nipple located between the slots is somewhat lifted, so that big, unobstructed gaps are formed on both slots, through which the liquid can exit. In contrast to this, a significant deformation of the slot is necessary in conventional teats in order to permit the exit of a corresponding amount of food. This is obtained only by a very high suction pressure. At parallel slots having a constant distance from the outer side towards the inner side of the suction nipple, the region between the slots can also be lifted in fact. However, an exit flow cross section is only made open when the region between the slots is lifted above the outer side of the suction nipple, which also requires a high suction work. When no sucking takes place, the bottle teat of the present invention closes particularly safely, because the region of the suction nipple between the two slots forms a kind of wedge, which comes to sit very closely on the outer sides of the two slots.

The bottle teat of the present invention is particularly suited to train children to drink from a cup, namely through the high yield when sucking and the safe sealing when the pressure is released. For this purpose, the suction nipple is preferably arranged eccentrically with respect to the mounting edge, as is known from conventional drinking cups for learning to drink.

According to a preferred embodiment, the two drinking slots are inclined in an angle with respect to each other. For instance, the angle is in the range of above 0° up to 180°. Preferably it is in the range of 5° up to 90°. The slots can be made in the bottle teat by suitable knives or cutting devices, respectively.

The bottle teat can be manufactured from a suitable soft elastic material. According to one embodiment, it is manufactured from natural rubber or silicone or from a thermoplastic elastomer (TPE). For instance, the bottle teat can be manufactured by injection moulding and subsequent machining of the slots by means of knives.

The present invention will be explained in more detail in the following by means of the attached drawings of an example of its realisation.

DETAILED DESCRIPTION OF THE INVENTION

Figure 1:
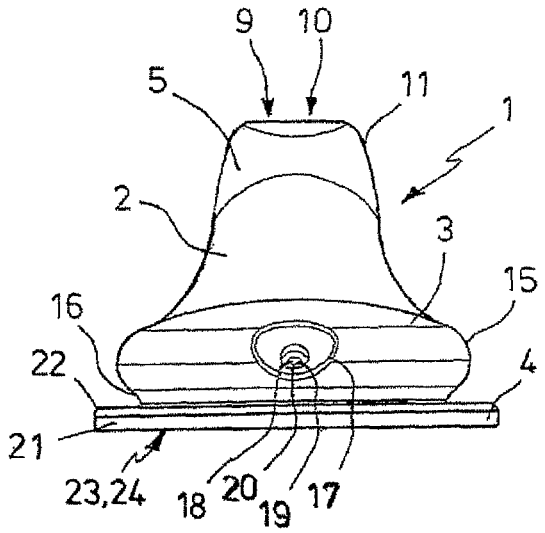
FIG. 1 shows the bottle teat in a front view.
Figure 2:
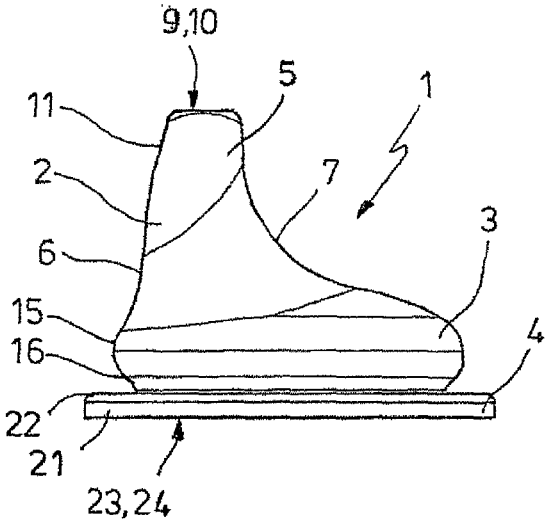
FIG. 2 shows the bottle teat in a view from the left side.
Figure 3:
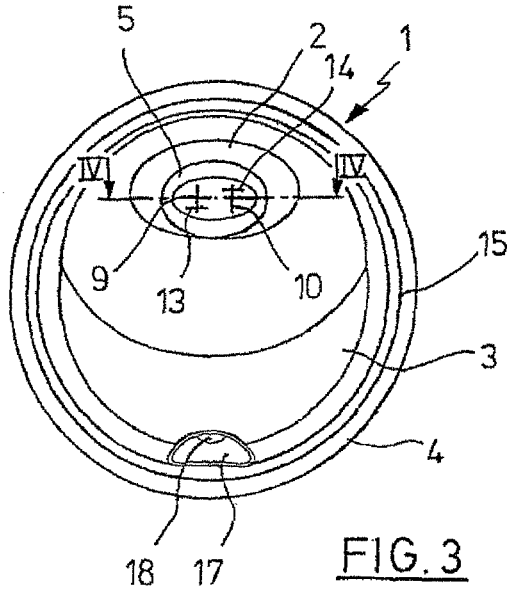
FIG. 3 shows the bottle teat in a top view.
Figure 4:
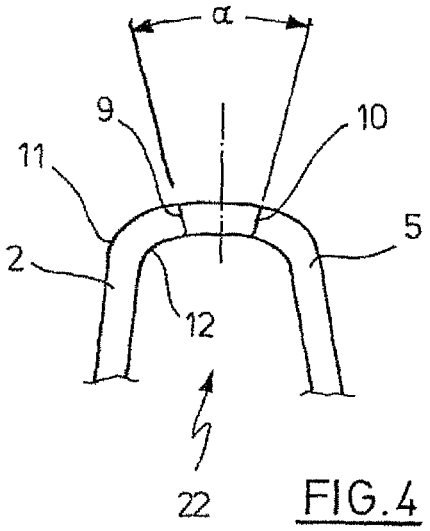
FIG. 4 shows the upper portion of the suction nipple of the same bottle teat in a vertical section along the line IV-IV of FIG. 3.
Figure 5:
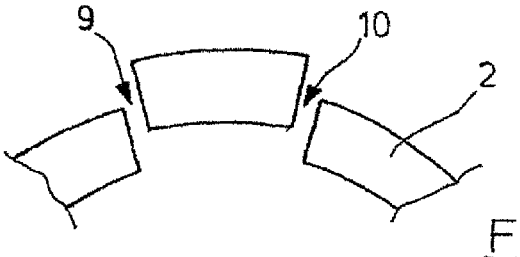
FIG. 5 shows the upper region of the same suction nipple when a suction pressure is applied, in a magnified vertical section of the cutting plane.

While this invention may be embodied in many different forms, there are described in detail herein a specific preferred embodiment of the invention. This description is an exemplification of the principles of the invention and is not intended to limit the invention to the particular embodiment illustrated The bottle teat 1 features a hollow suction nipple 2 which, via a hollow transition zone 3, is joined to a mounting edge 4 for fixation to the opening area of a bottle.

The suction nipple 2 has an oval cross-section which tapers towards an outer end region 5. The side 6 of the suction nipple 2 that is closest to the mounting edge 4 has a smaller curving than the opposite side 7 of the suction nipple 2 that is farther away from the mounting edge 4. The side 7 of the suction nipple 2 extends to terminate in a concave rounding 8 towards the transition zone 3.

The outer end region 5 of the bottle teat 2 is outwardly bulged, that is to say it is dome-shaped. In the outer end region 5 there are two drinking slots 9, 10, which are inclined with respect to each other in a vertical section. In the example, the angle between the two drinking slots 9, 10 is about 20° up to 30°. The drinking slots 9, 10 extend from the outer side 11 up to the inner side 12 of the bottle teat. Due to the angle between the two drinking slots 9, 10, the distance between them decreases from the outer side 11 towards the inner side 12 of the suction nipple 2.

In the top view onto the outer end region 5 of the suction nipple 2, the drinking slots 9, are disposed in parallel with respect to each other.

Each drinking slot 9, 10 is crossed by a further drinking slot 13, 14. The further drinking slots 13, 14 are also disposed in parallel with respect to each other. They extend from the outer side 11 up to the inner side 12 of the suction nipple in a constant distance from each other. The further drinking slots 13, 14 are shorter than each of the drinking slots 9, 10 to which they are respectively assigned. The further drinking slots 13, 14 are disposed in the vicinity of ends of the drinking slots 9, 10 that are distant from each other.

The suction nipple 2 passes gradually to the transition zone 3. In the transition zone 3, the bottle teat 1 enlarges gradually up to the greater diameter of the mounting edge 4. The transition zone 3 has a circumferential outer edge 15. A circumferential constriction 16 exists between the bead-shaped edge 15 and the mounting edge 4.

In the region of the circumferential outer edge 15, there is a depression 17, located diametrically opposed to the suction nipple 2 which is arranged eccentrically with respect to the mounting edge 4. A ventilation valve 18 is located in the depression 17. The ventilation valve 18 features two valve slots 19, 20 that cross each other. The valve slots 19, 20 extend from the outer side up to the inner side of the transition zone 3.

The mounting edge 4 comprises an essentially flat mounting flange 21 which has a circumferential boss 22 on the upper edge.

In the interior of the bottle teat there is a hollow space 23, which extends from the opening 24 surrounded by the mounting edge 4 through the transition zone 3 and the bottle teat 2 up to the drinking slots 9, 10 and the further drinking slots 13, 14.

When used, the bottle teat 1 is fastened by means of a not shown threaded ring on the edge of an opening of a not shown drinking bottle that is filled with liquid food.

When food is taken off, the drinking bottle is held such that the suction nipple 2 points slantly downward. When the suckling sucks on the suction nipple, a particularly great flow is made possible through the two drinking slots 9, 10 and the further drinking slots 13, 14. Moreover, the bottle teat 1 closes particularly tightly because of the wedge-shaped region between the drinking slots 9, 10. Also, the dimensions and the construction of the ventilation valve 16 favour the pressure compensation, and by this a high flow.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A bottle teat made of a soft elastic material, comprising: a hollow suction nipple (2), a circumferential mounting edge (4) for fixation to the bottle opening of a drinking bottle, a hollow transition zone (3) between the mounting edge (4) and the suction nipple (2), and two drinking slots (9, 10) having an outer side and an inner side and extending from the outer side (11) to the inner side (12) of the suction nipple (2) in an end region of the suction nipple (2), which outer sides are aligned in parallel to each other and whose distance from each other decreases from the outer side (11) towards the inner side (12) of the suction nipple (2), such that the region of the suction nipple located between the slots has a first configuration when suction is applied, wherein the region is somewhat lifted so that unobstructed gaps are formed on the two drinking slots for the exit of liquid, and a second configuration when suction is not applied wherein the region of the suction nipple between the slots obstructs the gaps by wedging against the outer sides of the two slots.

2. The bottle teat according to claim 1, wherein the outer end region of the suction nipple (2) featuring the drinking slots (9, 10) is outwardly bulged and each of the two drinking slots (9, 10) is formed by a cutting device.

3. The bottle teat according to claim 1, wherein a further pair of drinking slots (13, 14) that cross the drinking slots (9, 10) and extend from the outer side (11) towards the inner side (12) of the suction nipple (2) are arranged in the end region.

4. The bottle teat according to claim 3, wherein each one of the further drinking slots (13, 14) crosses only one drinking slot (9, 10).

5. The bottle teat according to claim 4, wherein the further drinking slots (13, 14) crossing different drinking slots (9, 10) are offset from each other.

6. The bottle teat according to claim 3, wherein the further drinking slots (13, 14) are aligned in parallel to each other.

7. The bottle teat according to claim 3 wherein the distance between the further drinking slots (13, 14) remains unchanged from the outer side (11) to the inner side (12) of the suction nipple (2).

8. The bottle teat according to claim 3 wherein the further drinking slots (13, 14) are perpendicular to the drinking slots (9, 10).

9. The bottle teat according to claim 3, wherein the drinking slots (9, 10) are longer than the further drinking slots (13, 14).

10. The bottle teat according to claim 1, wherein the suction nipple (2) has an oblong cross section.

11. The bottle teat according to claim 10, wherein the drinking slots (9, 10) are aligned in parallel to the minor axis of the oblong cross section, and the further drinking slots (13, 14) in parallel to the major axis thereof.

12. The bottle teat according to claim 1, wherein the suction nipple (2) features a cross section that tapers off towards the outer end.

13. The bottle teat according to claim 1, wherein the suction nipple (2) is arranged eccentrically with respect to the mounting edge (4).

14. The bottle teat according to claim 13, wherein one side (6) of the suction nipple (2) which is closest to the mounting edge (4) has a smaller curving than that side of the suction nipple (2) which is farthest away from the mounting edge (4).

15. The bottle teat according to claim 14, wherein the suction nipple (2) has a rounding (7) towards the transition zone (3) on the side that is remote from the mounting edge (4).

16. The bottle teat according to claim 1, wherein the transition zone (3) is dome-shaped.

17. The bottle teat according to claim 1, wherein a circumferential constriction (16) exists between the mounting edge (4) and the transition zone (3).

18. The bottle teat according to claim 1, which features a ventilation valve (18).

19. The bottle teat according to claim 18, wherein the ventilation valve (18) features at least one valve slot (18, 19) which extends from the outer side of the transition zone (3) up to the inner side of the transition zone (3).

20. The bottle teat according to claim 19, wherein the ventilation valve (18) is located in a depression (17) of the transition zone (3).

21. The bottle teat according to claim 20, wherein the depression (17) exists in the outer edge (15) of the dome-shaped transition zone (3).

22. The bottle teat according to claim 18, wherein the ventilation valve (17) is located diametrically opposite to the suction nipple (2) in the outer edge (15) of the transition zone (3).

23. The bottle teat according to claim 1, wherein the mounting edge (4) has a mounting flange (21).

24. The bottle teat according to claim 1, wherein the mounting flange (21) features a circumferential boss (22) on the upper edge.

25. The bottle teat according to claim 1, wherein the mounting edge (4) is annularly circular.

26. The bottle teat according to claim 1, which is manufactured from natural rubber or silicone or from a thermoplastic elastomer.

27. A bottle teat made of a soft elastic material, comprising: a hollow suction nipple, a circumferential mounting edge for fixation to the bottle opening of a drinking bottle, a hollow transition zone between the mounting edge and the suction nipple, and two self-closing drinking slots having an outer side and an inner side and extending from the outer side to the inner side of the suction nipple in an end region of the suction nipple, which outer sides are aligned in parallel to each other and whose distance from each other decreases from the outer side towards the inner side of the suction nipple, such that the region of the suction nipple located between the slots has a first configuration, wherein the region is somewhat lifted so that unobstructed gaps are formed on the two drinking slots for the exit of liquid, and a second configuration wherein the region of the suction nipple between the slots obstructs the gaps by wedging against the outer sides of the two slots in the absence of external forces applied.

28. The bottle teat according to claim 27, wherein the first configuration occurs when suction is applied.

* * * * *